US005427346A

United States Patent [19]

Urgola

[11] Patent Number: 5,427,346

[45] Date of Patent: Jun. 27, 1995

[54] BEACH UMBRELLA CARRYING CASE AND ANCHORING SYSTEM

[76] Inventor: Mark Urgola, 533 Park Pla., Lyndhurst, N.J. 07071

[21] Appl. No.: 189,076

[22] Filed: Jan. 28, 1994

[51] Int. Cl.[6] ..... F16M 13/00

[52] U.S. Cl. ..... 248/519; 135/16; 135/34.2; 206/216; 248/530; 248/910

[58] Field of Search ..... 248/519, 910, 530, 532, 248/535, 156; 135/16, 34.2; 206/216

[56] References Cited

U.S. PATENT DOCUMENTS 5,207,406 5/1993 Stine et al. ..... 248/519 X
5,347,667 9/1994 Schwarz et al. ..... 135/16 X

FOREIGN PATENT DOCUMENTS 2678977 1/1993 France ..... 135/16

*Primary Examiner*—Ramon O. Ramirez
*Attorney, Agent, or Firm*—Arnold D. Litt

[57] ABSTRACT

A carrying case and anchoring system for a beach umbrella and its support shaft is disclosed comprising in combination:

(1) Container means consisting of top, bottom and side members wherein the top and bottom members are operationally connected at one edge by hinge means to allow pivoting of the members about the axis of the hinge means whereby the container is opened and closed; wherein the top, bottom and side members define a hollow cavity when the carrying case is closed of sufficient size to receive a beach umbrella, its support shaft and a weighting medium for anchoring the container means, umbrella and support shaft; the top and bottom members being further characterized by possessing a plurality of paired openings situated through the top and bottom members wherein the openings of each pair are in direct opposition to one another such that when the carrying case is closed, the opening in the top member is juxtaposed upon the opening in the bottom member, thereby forming a channel through which the umbrella support shaft may be inserted;

(2) Locking means to secure the umbrella support shaft to the container means when it is closed and the support shaft is situated within the channel formed by the paired openings in the top and bottom members; and (3) Weighting Means which is placed within the container means hollow cavity to anchor the container means, beach umbrella and support shaft from wind forces.

In one embodiment, there are a plurality of openings, one pair forming a channel perpendicular to the top and bottom members of the container means, while another pair form a channel which is at an acute angle to the top and bottom members, thereby permitting the umbrella to adopt a variety of positions relative to the sun. In yet another embodiment of the invention, the locking means are contained within a hollow cylindrical sleeve which is inserted into the channel formed by the paired openings, the sleeve being flanged at one end to rest on the beach sand and open at the other end. The sleeve protrudes above the surface of the top member of the container means when it is closed. The umbrella support shaft is placed into the sleeve and locked into position by way of the locking means.

8 Claims, 3 Drawing Sheets

BEACH UMBRELLA CARRYING CASE AND ANCHORING SYSTEM

BACKGROUND OF THE INVENTION

1. Field of the Invention

The present invention relates to a portable beach umbrella carrying case and an anchoring system therefore.

2. Description of the Prior Art

The prior art portable beach umbrella carrying case systems have been described in the art but have been deemed inadequate to provide a system for carrying a beach umbrella with its support shaft and a weighting medium to stabilize the beach umbrella from wind gusts. Prior art systems have taught independent weighting means which must be carried separately from the carrying case such as the system shown in U.S. Pat. No. 4,924,893. It can therefore be appreciated that there is a continuing need for, and interest in, improvements in the securement of a portable beach umbrella carrying case and anchoring system which may be integrated into a light weight easy to use beach umbrella carrying case and anchoring system.

SUMMARY OF THE INVENTION

In view of the foregoing disadvantages inherent in the known types of portable beach umbrella carrying cases and anchoring systems now present in the prior art, the present invention provides an improved portable beach umbrella carrying case in combination with an anchoring system therefore which comprises the carrying case itself, when an appropriate weighting medium is added to the carrying case. As such, the general purpose of the present invention, which will be described subsequently in greater detail, is to provide a new and improved beach umbrella carrying case which also acts as an anchoring system or stabilization base when a weighting medium is added thereto. As indicated, this system combines ease of use and is sufficiently light weight to allow it to be carried back and forth from the beach. Since it is integrated into one system, it satisfies the numerous disadvantages of prior art systems which required a multiplicity of separate items to be brought to the beach in order to properly install and secure the portable beach umbrella, resulting in a greater cost to the user.

To attain this, representative embodiments of the concepts of the present invention are illustrated in the drawings.

Generally stated, the invention comprises a combination carrying case and anchoring system for a beach umbrella and its support shaft comprising:

(1) Container means consisting of top, bottom and side members wherein the top and bottom members are operationally connected at one edge by hinge means to allow pivoting of said members about the axis of said hinge means whereby the container means may be opened and closed; wherein the top, bottom and side members define a hollow cavity when the carrying case is closed of sufficient size to receive a beach umbrella, its support shaft and a weighting medium for anchoring said container means and said umbrella and support shaft; the top and bottom members further characterized by possessing a plurality of paired openings situated therethrough and wherein the openings of each pair are in direct opposition to one another, such that when the carrying case is closed, the opening of the top member is juxtaposed upon the opening in the bottom member, thereby forming a channel of a size sufficient to accommodate the umbrella support shaft which may be inserted therethrough;

(2) Locking means to secure the umbrella support shaft to the carrying case when the carrying case is closed and the support shaft is situated within said channel; and (3) Weighting means inserted within said carrying means hollow cavity to anchor said carrying means beach umbrella and support shaft from wind forces.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and may be practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as the basis for the designing of other structures, methods and systems for carrying out the several purposes of the present invention. It is important, therefore, that the claims be regarded as including such equivalent constructions insofar as they do not depart from the spirit and scope of the present invention.

Furthermore, the purpose of the foregoing Abstract is to enable the U.S. Patent and Trademark Office and the public generally, and especially any scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured by the claims, nor is it intended to be limiting as to the scope of the invention in any way.

It is therefore an object of the present invention to provide a new and improved portable beach umbrella carrying case which has all of the advantages of the prior art but none of their disadvantages.

It is another object of the present invention to provide a new and improved portable beach umbrella carrying case which also acts as a anchoring system to stabilize the beach umbrella in the presence of wind forces.

It is a further object of the present invention to provide a new and improved portable beach umbrella carrying case which is durable, reliable, low cost, easily and efficiently manufactured and marketed.

It is still another object of the present invention to provide a portable beach umbrella carrying case which is lightweight and easy to carry and which is spacious enough to contain a knock down beach umbrella and its support shaft as well as other beach related items.

It is another object of the present invention to utilize a no cost weighting medium such as sand at the beach to provide stability to the carrying case when the beach umbrella and support shaft are inserted therethrough and, by way of locking means, integrated therein.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be understood and objects other than those set forth above will become apparent when consideration is given to the following detailed description thereof. Such description makes reference to the annexed drawings wherein.

DETAILED DESCRIPTION OF THE INVENTION

Figure 1:
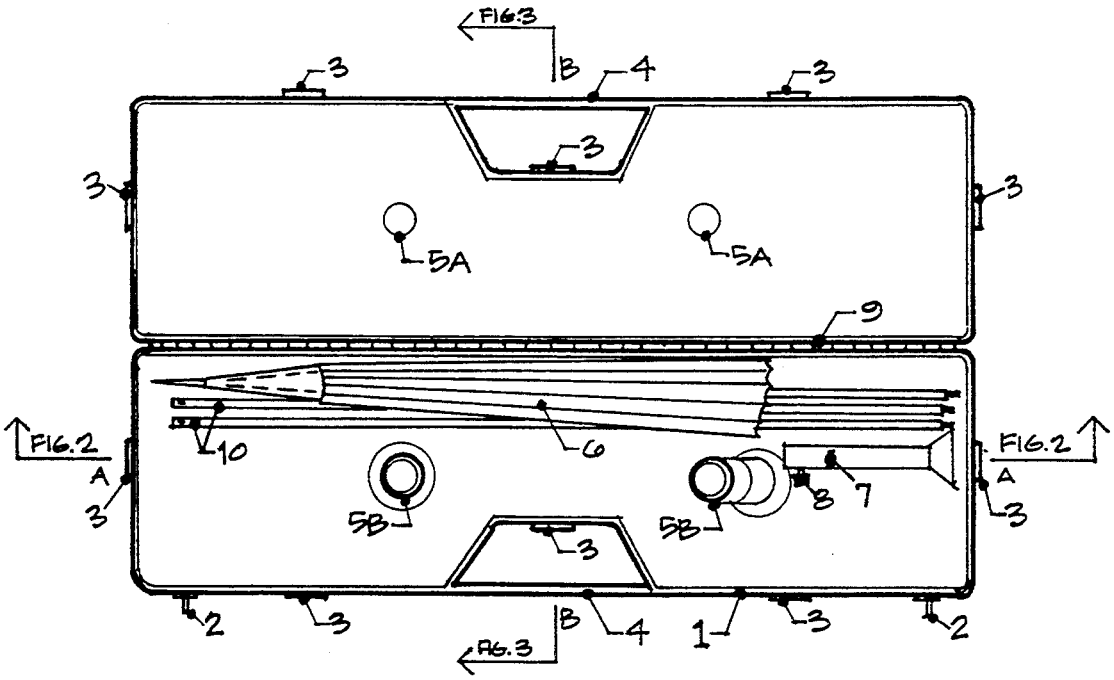
FIG. 1 Top view perspective of the open container means.
Figure 7:
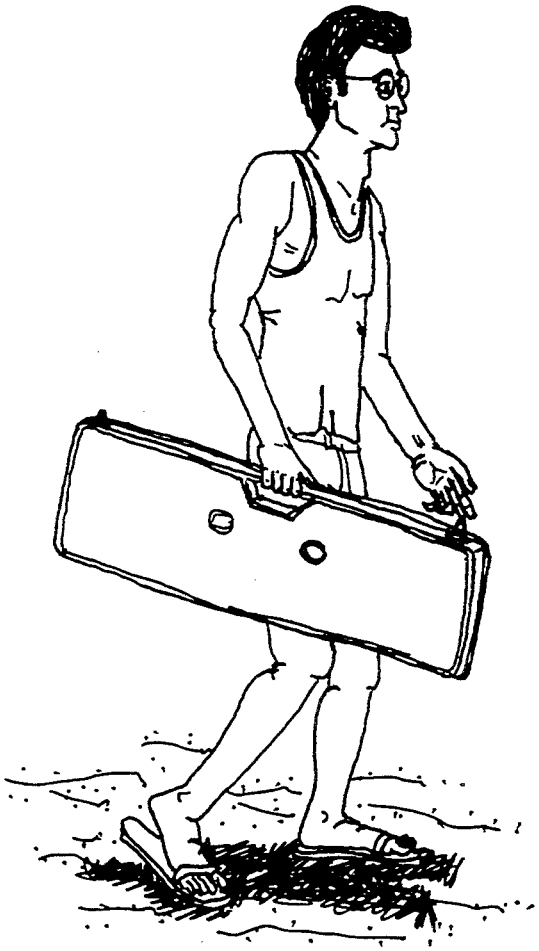

FIG. 1 illustrates a perspective view of the container means 1 in its opened configuration. Hooks 2 are attached to the exterior of the container means to permit shoulder straps to be inserted therethrough so that the container means can be carried Locking latches 3 are provided to lock the container means in the closed configuration. Alternatively, built-in handles 4 are provided which permit an individual to carry the closed container means as an alternative to using the shoulder strap, as more clearly shown in FIG. 7. Paired openings 5A are situated in the top member of the container means and are in direct opposition to paired openings 5B in the bottom member of the container case, such that when the carrying case is closed, the openings 5A are juxtaposed upon the openings 5B, thereby forming a channel of a size and diameter sufficient to accommodate the umbrella shaft segments 10 which are detached from each other and from the umbrella 6 when they are being carried within the container means.

Figure 2:
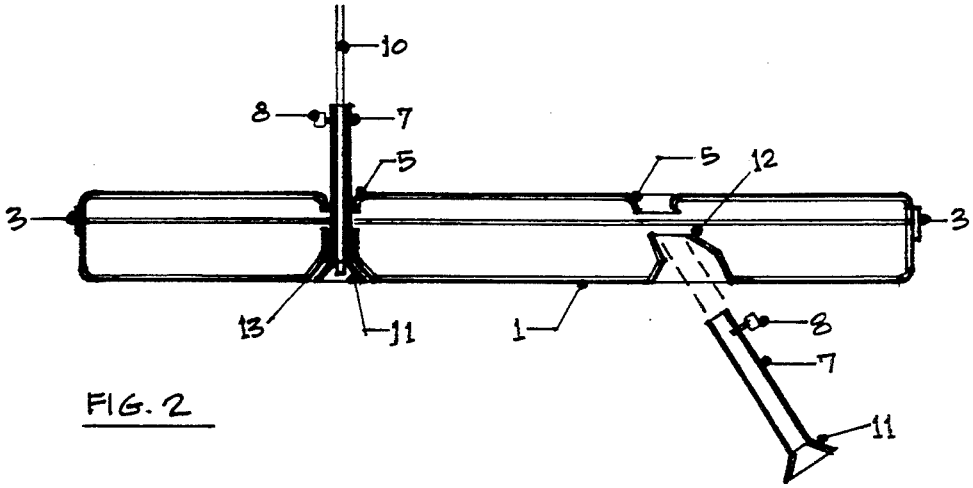
FIG. 2 Cross-sectional side view of the container means along line A—A.

As shown in FIG. 2, a hollow cylindrical sleeve 7 is utilized in a preferred embodiment to give added support to the umbrella 6 and its support shafts 10. In practice, the container means is closed and the shaft 7 inserted from the bottom. The top most portion of the sleeve protrudes above the surface of the top member of the container means 1. The sleeve is flanged at its bottom-most portion 11 and rests on the surface of the beach. Support shaft segment 10 is inserted through the sleeve where it is locked into place by locking means 8 located on the sleeve. In this embodiment, the locking means is shown as a wing nut but in actual operation any appropriate prior art locking means may be utilized.

Depending upon the angle of the sun relative to an individual sitting under the umbrella, the umbrella angle may be varied by inserting the support shaft and sleeve 7 either in channel 12 (which is at an acute angle to the upper surface of the container means) or in channel 13 (which is perpendicular to the upper surface of the container means), thereby casting a shadow resulting in more or less protection for an individual sitting underneath the umbrella from the rays of the sun. In other embodiments, other angularities may be chosen so that, for example, the umbrella forms an obtuse angle relative to the top member of the container means, again, directing more or less sun on the individual sitting near or under the umbrella.

Figure 3:
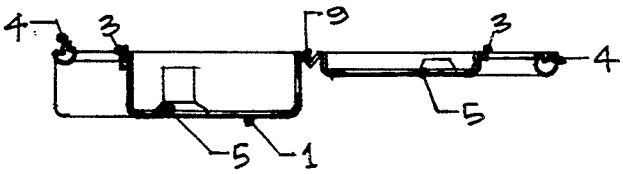
FIG. 3 Cross-sectional side view of the container means along line B—B.

In FIG. 3, the openings 5 are illustrated. Built-in handle 4 is shown in side view and hinge means 9 is provided, permitting the opening and closing of the container means.

Figure 4:
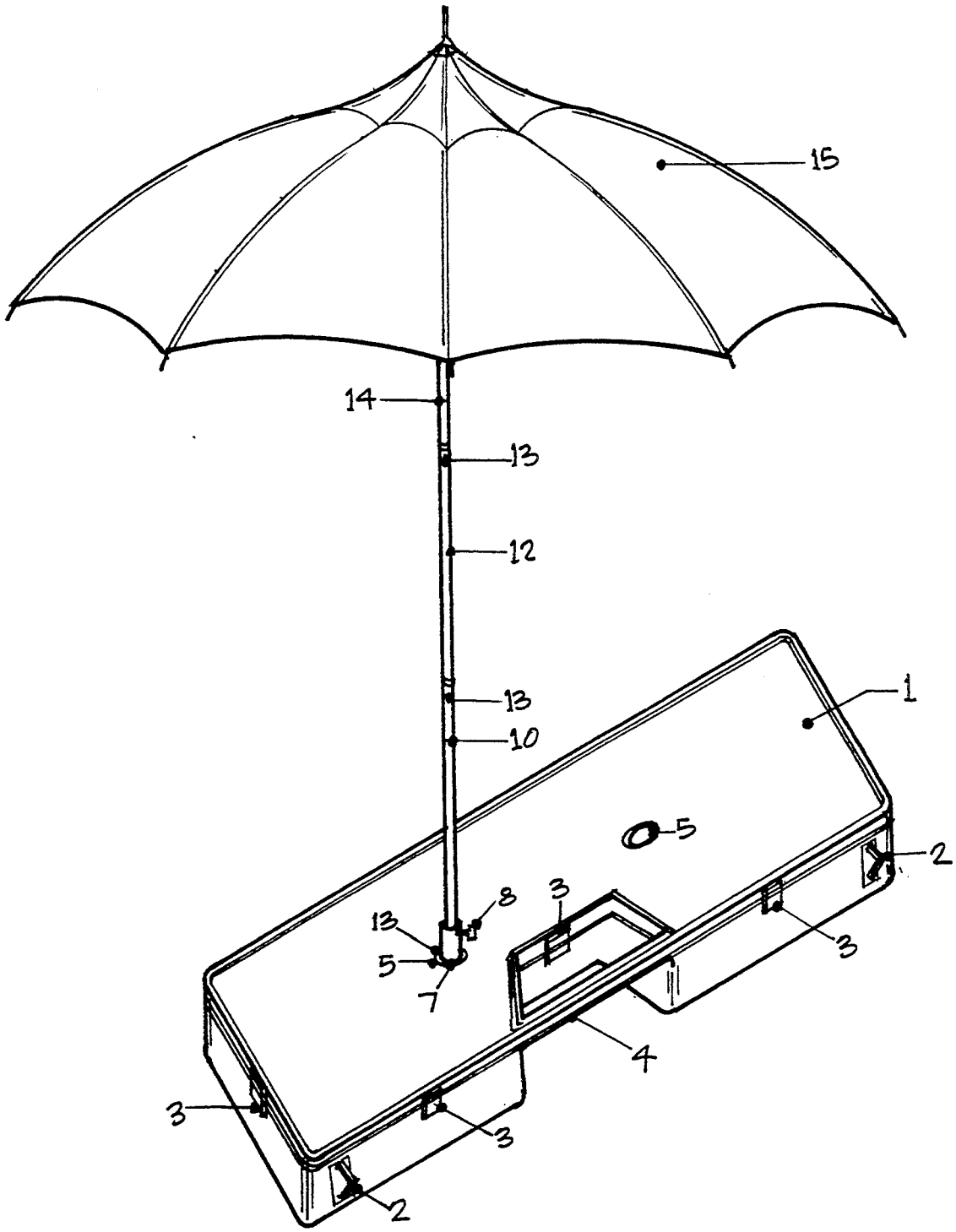
FIG. 4 Perspective view of umbrella, umbrella support system and carrying case.

FIG. 4, shows the entire unit in perspective. Umbrella support shaft segment 10 is shown locked into sleeve 7 by locking means 8, the locking means comprising a wing nut in this embodiment. An intermediary support shaft segment 12 fits into the bottom support shaft segment 10 and is locked into place by locking means 13. Although any prior art locking means may be utilized in connection with joining one umbrella support shaft segment to another, preferred locking means comprises a retractable spring-mounted button 13 which may be depressed to permit entry of another support shaft segment 12 therein. A hole is situated at an appropriate distance from one end of the support shaft segment so that when the hole and the button in support shaft segment are aligned, the button passes through the hole thereby locking the two segments into place. The top most support shaft segment 14 has a collapsible umbrella 15 attached thereto and is inserted into the intermediary support shaft segment and locked into place by retractable spring-mounted button 13, thereby completing the umbrella configuration.

The weighting means comprises sand from the beach. After the container means is emptied, sand is placed into the bottom of the container means which is then closed. The sleeve 7 is inserted through channel 13 and the support shafts and umbrella are then set up and locked into place as previously described thereby resulting in the final anchored carrying case and umbrella. If desired, a small shovel can be included in the carrying case for ease of bringing the sand into the said container means.

Figure 5:
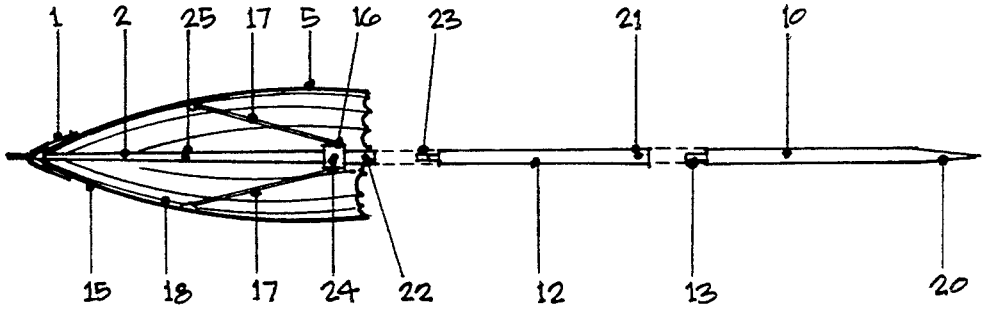
FIG. 5 Exploded view of a perspective of the umbrella and support shaft segments.
Figure 6:
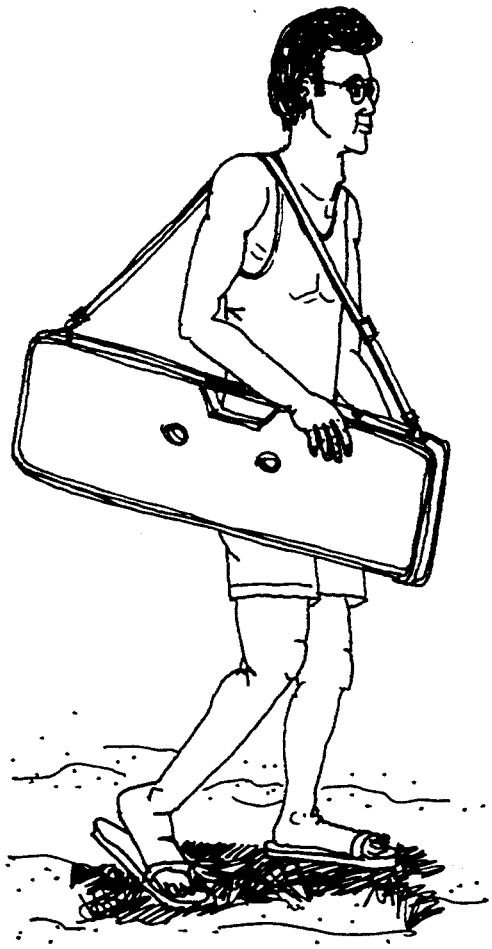

FIG. 5 represents an exploded view of a perspective of the umbrella. The bottom most shaft segment 10 has a tapered end Retractable spring-mounted button 13 fits into hole 21 situated in intermediary shaft segment 12, when hole 21 and button 13 are aligned thereby locking the bottom most shaft segment 10 and intermediary segment 12 into place. The upper most support shaft member 14 is locked into intermediary support shaft segment 12 by alignment of button 23 and hole 22. The umbrella is opened by pushing collar 16 up the umbrella support segment 14, forcing rods 17 to bow outward thereby opening the umbrella to its full width. When hole 24 in collar 16 aligns with button 25 in shaft support segment 14, the umbrella is locked into an open configuration.

It is noted that sleeve 7 (FIG. 2) while preferred to further stabilize the umbrella support segments, is not essential to the operation of the invention. Thus, the bottom most shaft segment 10 (FIG. 5) can be inserted through opening 5 (FIG. 2) without utilizing sleeve 7. The segment 10, given its tapered end, can be forced into the beach sand and locked into place by wing nut 8 (FIG. 2).

Having described the invention, what is claimed i:

1. A combination carrying case and anchoring system for a beach umbrella and its support shaft comprising:

(1) Container means consisting of top, bottom and side members wherein the top and bottom members are operationally connected at one edge by hinge means to allow pivoting of said members about the axis of said hinge means wherein the container means may be opened and closed; and wherein the top, bottom and side members define a hollow cavity when the container means is closed of sufficient size to receive a beach umbrella, its support shaft and a weighting medium for anchoring said container means and said umbrella and support shaft, the top and bottom members further characterized by possessing a plurality of paired openings situated therethrough and wherein the openings of each pair are in direct opposition to one another, such that when the carrying case is closed, the opening in the top member is juxtaposed upon the opening in the bottom member, thereby forming a channel of a size sufficient to accommodate the umbrella support shaft which may be inserted therethrough;;

(2) Locking means to secure the umbrella support shaft to the carrying case when the carrying case is closed and the support shaft is situated within said channel; and (3) Weighting means situated within said hollow cavity to anchor said carrying means, beach umbrella and support shaft from wind forces.

2. The weighting means of claim 1 comprising beach sand.

3. The container means of claim 1 in which said channel is perpendicular to the top and bottom members.

4. The container means of claim 1 in which said channel forms an acute angle with the top member.

5. The container means of claim 1 wherein a hollow cylindrical sleeve of a size sufficient to accommodate an umbrella support shaft is removably situated within the channel, one end of the sleeve being flanged so as to form a base which rests on the beach surface and the other end of which being open to receive the support shaft, and wherein locking means are provided whereby the support shaft is secured to the sleeve.

6. The channel of claim 1 wherein locking means are provided to secure the umbrella support shaft thereto.

7. The locking means of claim 6 comprising a wing nut.

8. A combination carrying case, anchoring system and support shaft for a beach umbrella comprising:

(1) Container means consisting of top, bottom and side members wherein the top and bottom members are operationally connected at one edge by hinge means to allow pivoting of said members about the axis of said hinge means wherein the container means may be opened and closed; and wherein the top, bottom and side members define a hollow cavity when the container means is closed of sufficient size to receive a beach umbrella, its support shaft and a weighing medium for anchoring said container means and said umbrella and support shaft, the top and bottom members further characterized by possessing a plurality of paired openings situated therethrough and wherein the openings of each pair are in direct opposition to one another, such that when the carrying case is closed, the opening in the top member is juxtaposed upon the opening in the bottom member, thereby forming a channel of a size sufficient to accommodate the umbrella support shaft which may be inserted there through; said support shaft comprising a plurality of shaft segments which are releasably connected to each other and locking means situated within each shaft segment to secure one shaft segment to another and wherein the bottom-most shaft segment is tapered at one end to permit its facile insertion into the sand at the beach and wherein the top most shaft segment is operationally connected to the umbrella; and (2) Locking means to secure the umbrella support shaft to the carrying case when the carrying case is closed and the support shaft is situated within said channel; and (3) Weighing means situated within said hollow cavity to anchor said carrying means, beach umbrella and support shaft from wind forces.

* * * * *